US006722225B1

(12) United States Patent
Martinovsky

(10) Patent No.: US 6,722,225 B1
(45) Date of Patent: Apr. 20, 2004

(54) PEDAL MECHANISM

(75) Inventor: Jan Martinovsky, Steinbach (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/646,381

(22) PCT Filed: Mar. 20, 1999

(86) PCT No.: PCT/EP99/01887

§ 371 (c)(1),
(2), (4) Date: Nov. 14, 2000

(87) PCT Pub. No.: WO99/50110

PCT Pub. Date: Oct. 7, 1999

(30) Foreign Application Priority Data

Mar. 28, 1998 (DE) ..... 198 13 845

(51) Int. Cl.[7] ..... G05G 1/14
(52) U.S. Cl. ..... 74/512; 74/513; 74/560
(58) Field of Search ..... 74/512–514, 560; 267/44, 158

(56) References Cited

U.S. PATENT DOCUMENTS

| | | | | | |
|---|---|---|---|---|---|
| 3,621,959 | A | * | 11/1971 | Gale | 192/111 A |
| 3,739,579 | A | * | 6/1973 | Lutz | 74/512 X |
| 3,972,190 | A | * | 8/1976 | Sawyer | 74/512 X |
| 4,005,617 | A | * | 2/1977 | Sourbel et al. | 74/516 |
| 4,907,468 | A | * | 3/1990 | Hagiwara et al. | 74/512 |
| 5,133,225 | A | * | 7/1992 | Lundberg et al. | 74/560 |
| 5,211,019 | A | * | 5/1993 | Bauer | 60/550 |
| 6,109,133 | A | * | 8/2000 | Kohlen | 74/512 |
| 6,250,176 | B1 | * | 6/2001 | Reimann et al. | 74/512 |
| 6,253,635 | B1 | * | 7/2001 | Huber | 74/512 |

FOREIGN PATENT DOCUMENTS

| | | | | |
|---|---|---|---|---|
| DE | 1114715 | | 10/1961 | |
| DE | 2531855 | | 1/1976 | |
| DE | 2638962 | * | 3/1978 | 74/512 |
| DE | 8809962 | | 10/1988 | |
| DE | 3923459 | | 1/1991 | |
| DE | 4229263 | | 3/1993 | |
| EP | 0854071 | | 7/1998 | |
| FR | 2696397 | | 4/1994 | |

OTHER PUBLICATIONS

Halliday Resnick, PHYSICS, Parts I & II, Publisher: John Wiley & Sons, Inc., pp. 86–91.*

* cited by examiner

*Primary Examiner*—Vinh T. Luong

(57) ABSTRACT

A pedal lever (2) for actuation with the foot is connected to an actuating element (18) by a spring element (12) in such a manner that an actuating force is introduced directly or by a component (13), but the restoring force introduced into the pedal lever (2) by a restoring spring element (6) is transmitted only up to a maximum permitted value. As soon as this value is exceeded, the spring element (12) absorbs the force exceeding it. As a result, the actuating element (18) is protected against damage caused by excessive introduction of force during the restoring movement.

11 Claims, 6 Drawing Sheets

PEDAL MECHANISM

FIELD AND BACKGROUND OF THE INVENTION

The invention relates to a pedal mechanism, in particular for a vehicle, having a pedal lever which is mounted pivotably about an axis, can be deflected by foot force and can be pivoted back into a basic position by a restoring spring element, an actuating element being actuable by the pedal lever.

Pedals of the abovementioned type have long been customary in motor vehicles and are therefore generally known. If the driver of a motor vehicle moves back his foot which is actuating the pedal lever, the pedal lever then has to follow this movement. If the driver takes his foot off the pedal lever completely in order, for example, to actuate the accelerator after a braking procedure, the pedal lever then has to move back relatively rapidly into its inoperative position. This restoring movement is usually made possible by means of a restoring spring element. When the actuating force is suddenly taken away by the foot letting go or sliding off from the pedal lever, the spring force of the restoring spring element causes the pedal lever to accelerate relatively powerfully (what could be termed allowing it "to snap"). If this movement is only stopped by the actuating element as soon as it has reached its maximum deflection or has arrived against its stop, it may be that the force applied to the actuating element by the momentum of the pedal lever exceeds the highest permissible force and damage to the actuating element occurs.

Overloading of the actuating element can be counteracted by a stop or a stopper which limits the movement of the pedal arm being provided on the pedal mechanism. However, it has proven disadvantageous here that the stop has to be matched exactly to the associated actuating element in order to achieve the desired effect. This requires complicated setting and adjusting activities, which are associated in turn with increased costs. At the same time, the conversion to different vehicle or motorization variants is also difficult. Furthermore, the maximum possible deflection, which is limited by the actuating element, is reduced by the stop, since the theoretically possible maximum deflection has to be reduced by a safety margin which ensures permanently reliable

SUMMARY OF THE INVENTION

The invention is based on the object of providing a pedal mechanism of the described type, in which damage to the actuating element can largely be ruled out and at the same time a stop or a stopping element for limiting the restoring movement of the actuating element can be dispensed with.

According to the invention this problem is solved by the pedal lever being connected to the actuating element by a spring element which is provided in order to limit the force transmitted to the actuating element by the pedal lever during the restoring movement of the pedal lever by decoupling the pedal lever from the actuating element. By this means, when the pedal lever is actuated, the actuating element is actuated as in the case of a conventional pedal lever and the actuating force is transmitted to the actuating element. When the actuating force is suddenly taken away, the pedal lever swings back under the action of the restoring spring force. If, in this case, the highest permissible force for the actuating element is exceeded, the spring element is tensioned. The maximum force acting on the actuating element in the release direction is therefore determined by the configuration of the spring element. Damage to the actuating element, which may be a hydraulic cylinder, for example, is therefore ruled out. A stop can either be omitted completely or serves merely to limit the movement in the restoring direction if the spring element is tensioned and the distance between the pedal lever and the actuating element is therefore enlarged.

A particularly advantageous embodiment of the invention is provided if a component is arranged between the actuating element and the spring element, which component is designed such that in the actuating direction, it can move together with the pedal lever, and, in the restoring direction, it can move relative to the pedal lever against the spring force of the spring element. This makes it possible, on the one hand, to decouple the actuating element during the restoring movement from the movement of the pedal lever and, on the other hand, to relieve the load on the spring element in the actuating direction. A defined path of movement in the component is preferably established. Lateral deviation of the actuating element is thus prevented. The actuating element therefore reliably returns into its inoperative position.

It is advantageous here if the component bears against the pedal lever when the latter is actuated. As a result, the actuating force is transmitted to the actuating element from the pedal lever by means of the component with the spring element being excluded. By this means, the spring element is not subjected to load when the pedal is actuated and is therefore subject to considerably less wear. Possible compliance of the pedal mechanism in the actuating direction, caused by the spring element being loaded in a direction opposed to the direction of action, can therefore be avoided.

A particularly simple embodiment of the invention in terms of structure is one in which the component and the pedal lever are arranged pivotably about a common axis. This enables very compact constructions of the pedal mechanism to be realized. At the same time, the path of movement of the arrangement, in particular of the actuating element, is unchanged as compared to a conventional pedal mechanism. Only very slight changes to existing pedal mechanisms are therefore required, and so this embodiment is also suitable for retrofitting purposes.

The present invention is suitable in principle for all intended uses. The pedal mechanism according to the invention is particularly suitable for use in a motor vehicle if the pedal lever is a brake pedal lever and the actuating element is a braking device. While accelerators are increasingly provided with electric actuating elements whose actuating forces can be configured to be considerably lower, brake pedal levers in passenger vehicles and commercial vehicles are generally also used for the (hydro)mechanical transmission of -the actuating force to a braking device or for the (hydro)mechanical activation of a brake servo. The restoring force of the restoring spring element then depends primarily on the configuration of the braking device and brake servo. These are generally produced in large piece numbers, with the result that individual configurations for the intended purpose, in particular with an individually reinforced stop for the pedal mechanism, are generally not possible.

A particularly simple embodiment of the invention is provided if the spring element is a tension spring. This can easily be integrated into the connection between the pedal lever and the actuating element and at the same time can also be designed to transmit compressive forces.

Another embodiment is provided if the spring element is a compression spring. In the event of the spring element failing, for example should the spring element break, such a spring element makes possible a restoring movement of the actuating element. The actuating element is thus decoupled from excessively high restoring forces, on the one hand, but at the same time has a stop which guides the actuating element into the inoperative position when the compression spring is pressed to the maximum. This may, for example, be effective if the actuating element is jammed in an operating position and no longer returns into the inoperative position.

A further advantageous embodiment is provided with a pedal mechanism in which the spring element is a leg spring. This enables a pedal mechanism to be formed which is space-saving and reliable at the same time. To this end, it is possible for the leg spring to be pivotable, for example, about an axis which is shared with the pedal lever and, in a similar manner to a clothes peg, to be supported with one spring clothes arm on the upper side of the pedal arm and, to compress with the other spring arm, the actuating element against the under side of the pedal lever. When the pedal lever is actuated, the actuating force acts directly on the actuating element, and during the restoring movement, when a maximum permissible force is exceeded, the leg spring separates the actuating element from the pedal arm, as a result of which these are pivoted toward each other.

Play in the pedal lever can be effectively avoided if, in accordance with another advantageous development of the invention, in the basic position the spring force of the spring element is greater than the spring force of the restoring spring element. This enables the pedal mechanism to be operated particularly regularly and safely.

BRIEF DESCRIPTION OF THE DRAWINGS

The invention permits numerous embodiments. To further clarify its principle two of these are illustrated in the figures of the drawings and are described below with reference to an actuating cycle. In the drawings in a lateral and partially sectional illustration.

DETAILED DESCRIPTION OF THE PREFERRED EMBODIMENT

Figure 1:
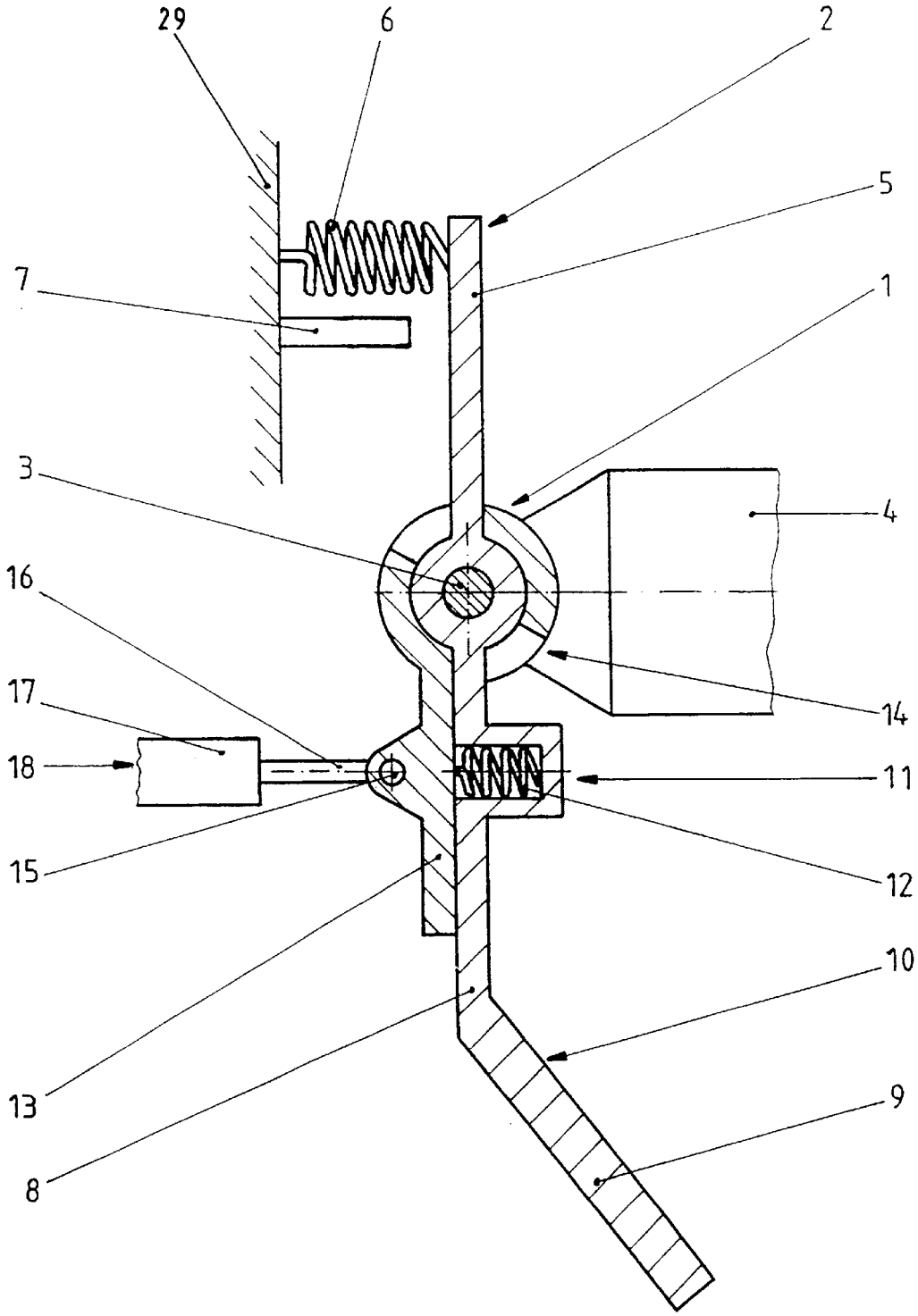
FIG. 1 shows a pedal mechanism according to the invention having a spring element which is designed as a tension spring, in its inoperative position.

FIG. 1 shows a pedal mechanism 1 according to the invention in a side view. In this case, a pedal lever 2 is mounted pivotably about an axis 3 which is arranged on a positionally fixed bearing arrangement 4. The pedal lever 2 has a lever arm 5 having a restoring spring element 6 which is designed as a tension spring, is supported against a positionally fixed abutment, which is designed as a base plate 29 of the pedal mechanism 1, and in the inoperative position which is illustrated is relaxed. The lever arm 5 is at a small distance from a positionally fixed stop 7, which is designed, for example, as a rubber buffer. On a lever arm 8 which lies opposite the lever arm 5, the pedal lever 2 has a section 10 which is designed as a pedal plate 9 and is designed for actuation with the foot. Likewise arranged on the lever arm 8 of the pedal lever 2 is an approximately cup-shaped holder 11 for a spring element 12 which is inserted therein and is designed as a tension spring. The spring element 12 connects the pedal lever 2 to a component 13 which is likewise mounted pivotably about the axis 3. The lever arm 8 of the pedal lever 2 is inserted into a recess 14 of the component 13 in such a manner that a movement, which is largely independent of the component 13, about the axis 3 is possible. The component 13 is furthermore connected by means of a pin 15 to a piston rod 16 of an actuating element 18, which is designed as a braking device 17 and only certain sections of which are illustrated. In the inoperative state which is illustrated, the spring force of the spring element 12 is greater than the spring force of the restoring spring element 6, with the result that the lever arm 8 of the pedal lever 2 bears against the component 13 which is connected to the piston rod 16.

Figure 2:
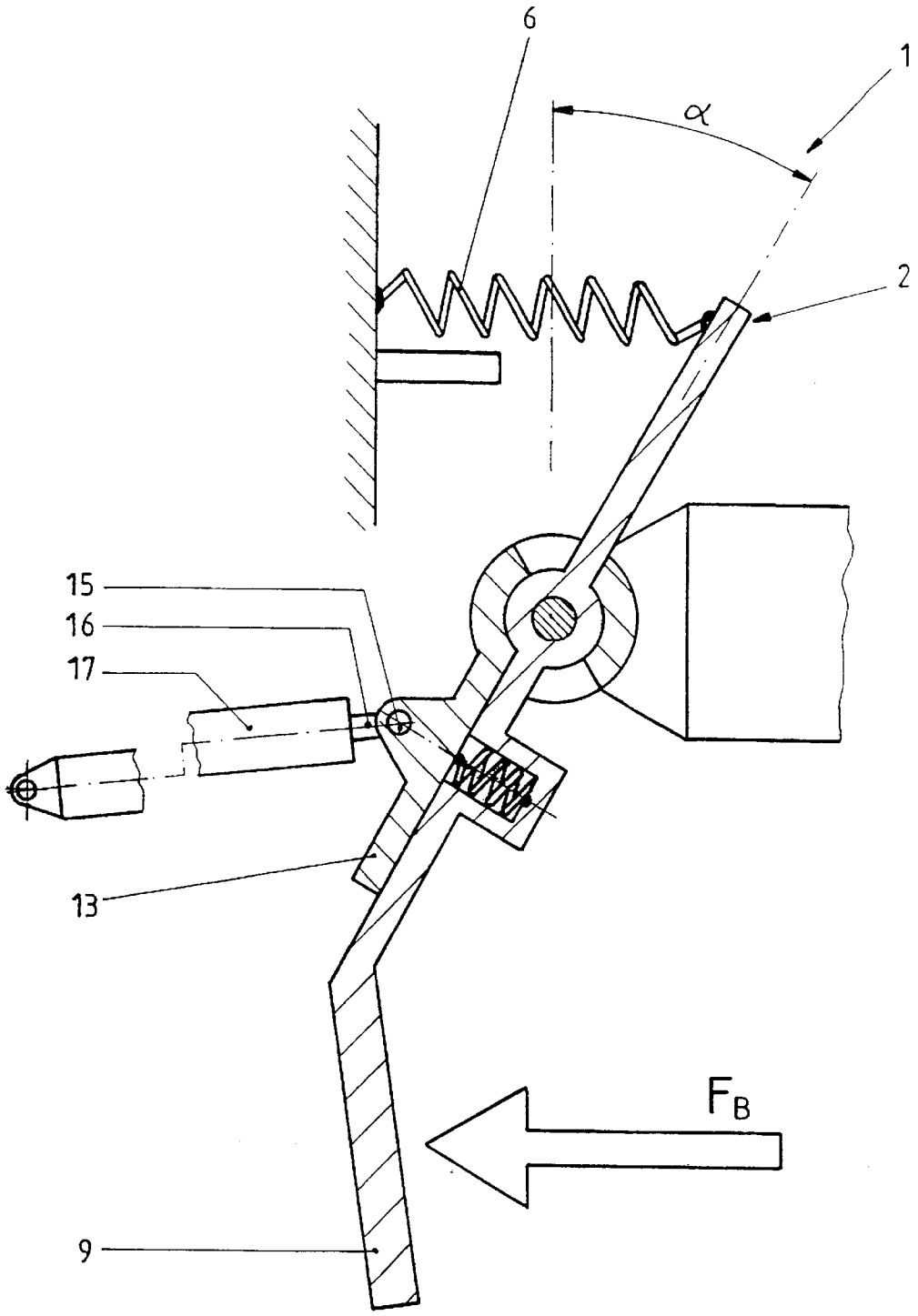
FIG. 2 shows the pedal mechanism which is illustrated in FIG. 1, in an actuating position.

FIG. 2 shows the pedal mechanism 1 in an actuating position which is loaded by the actuating force $F_B$. Compared to the inoperative position illustrated in FIG. 1, the pedal level 2 is now situated in a position which is deflected counter to the spring force of the restoring spring element 6 by an angle of deflection $\alpha$. In this case, the actuating force $F_B$ which acts on the pedal plate 9 of the pedal lever 2 is transmitted to the component 13 which is pivoted together with the pedal lever 2 and bears against the latter. The piston rod 16 of the braking device 17, which piston rod is actuated by means of the pin 15, is therefore partially inserted into the braking device 17. No forces act here on the spring element 12.

Figure 3:
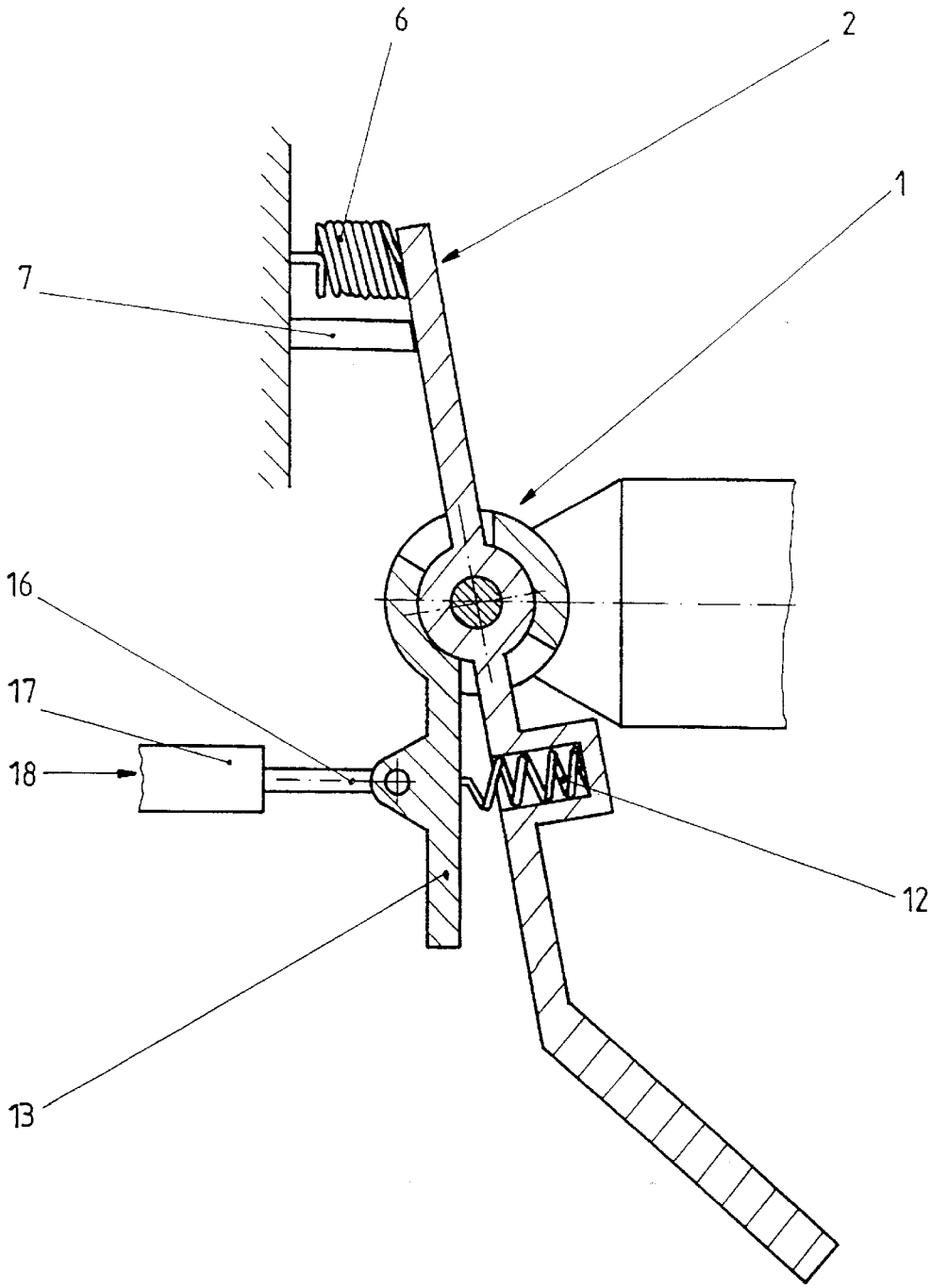
FIG. 3 shows the pedal mechanism which is illustrated in FIG. 1, in a position after the sudden letting go of the pedal lever.

FIG. 3 shows the pedal mechanism 1 in a position after a sudden falling away of the actuating force ($F_B$). The component 13 is returned again into its inoperative position which is illustrated in FIG. 1. In this case, the force applied to the spring element 12 by the restoring spring element 6 in conjunction with the mass moment of inertia of the pedal lever 2 has exceeded a maximum permissible force. The pedal lever 2 is therefore situated in a position which is pivoted with respect to the component 13 against the spring force of the spring element 12. The restoring force acting on the actuating element 18, which is designed as a braking device 17, corresponds in this case to the force transmitted by the spring element 12. The piston rod 16 is therefore situated in a position drawn out of the braking device 17 to its maximum. Decoupling the pedal lever 2 from the braking device 17 prevents damage to the braking device 17 due to inadmissibly high restoring forces. Because of the relatively great spring force of the spring element 12 in the inoperative position as compared to the spring force of the restoring spring element 6, the lever arm 8 of the pedal lever 2 is again pulled up to the component 13, which is connected to the piston rod 16.

Figure 4:
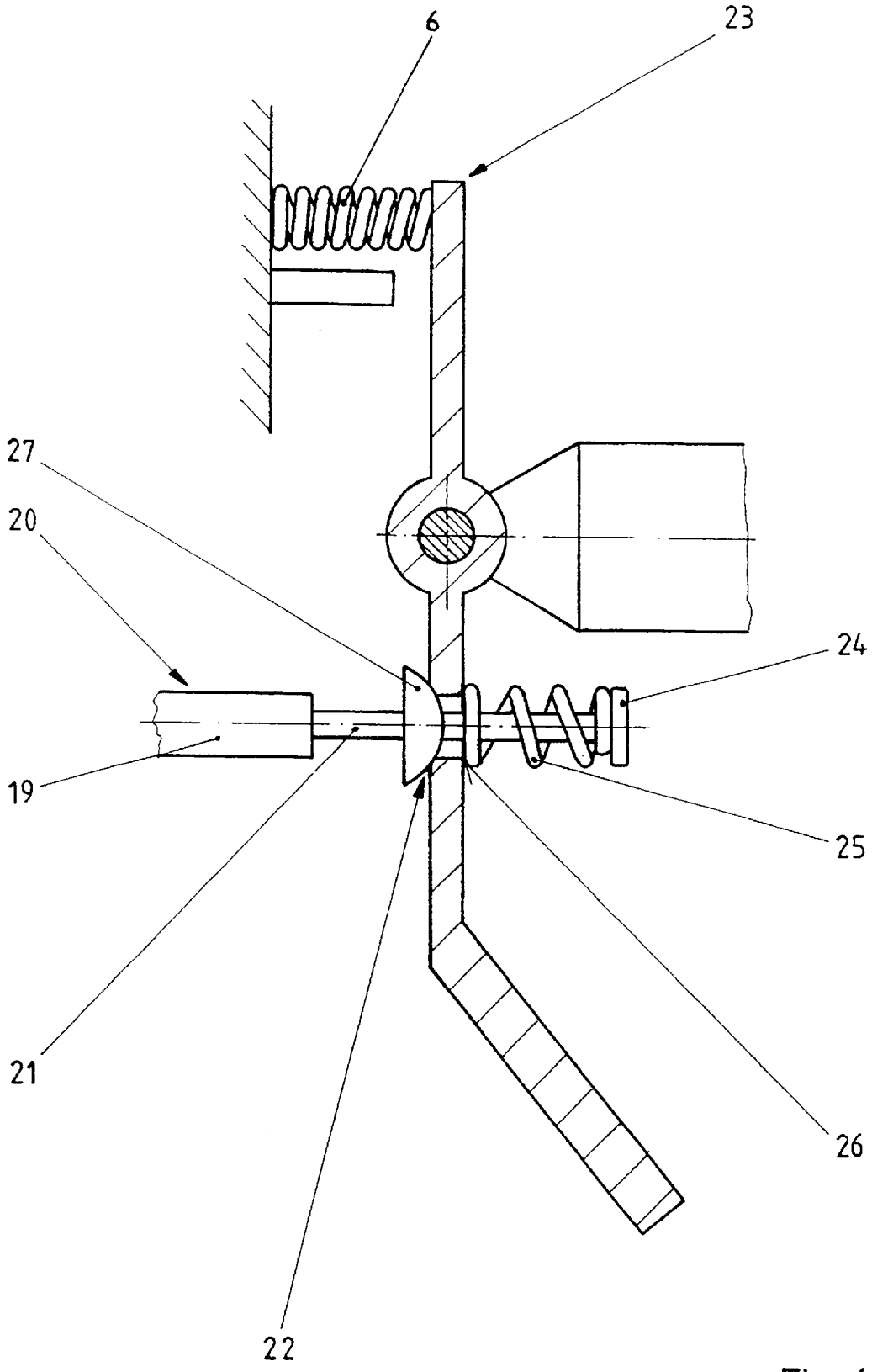
FIG. 4 shows a further pedal mechanism according to the invention with a spring element which is designed as a compression spring, in its inoperative position.

FIG. 4 shows an embodiment which is modified as compared to the pedal mechanism illustrated in FIGS. 1 to 3, in which corresponding components are provided with corresponding reference numbers. In this case, an actuating element 20, which is designed as a braking device 19, is passed through a recess 22 in a pedal lever 23 by means of a piston rod 21. Between an expanded portion 24, which is arranged at the free end of the piston rod 21, and the recess 22 a spring element 25, which is designed as a compression spring, surrounds an end section of the piston rod 21. The spring element 25 is supported here on an edge 26 of the recess 22. On that side of the pedal lever 23 which lies opposite the spring element 25 a curved component 27, which is connected fixedly to the piston rod 21, bears against the recess 22. In the rest state which is illustrated, the spring force of the spring element 25 is greater than the spring force of a restoring spring element 6, which is designed as a tension spring, with the result that the pedal lever 23 is clamped between the curved component 27, which is connected to the piston rod 21, and the spring element 25, which is designed as a compression spring.

Figure 5:
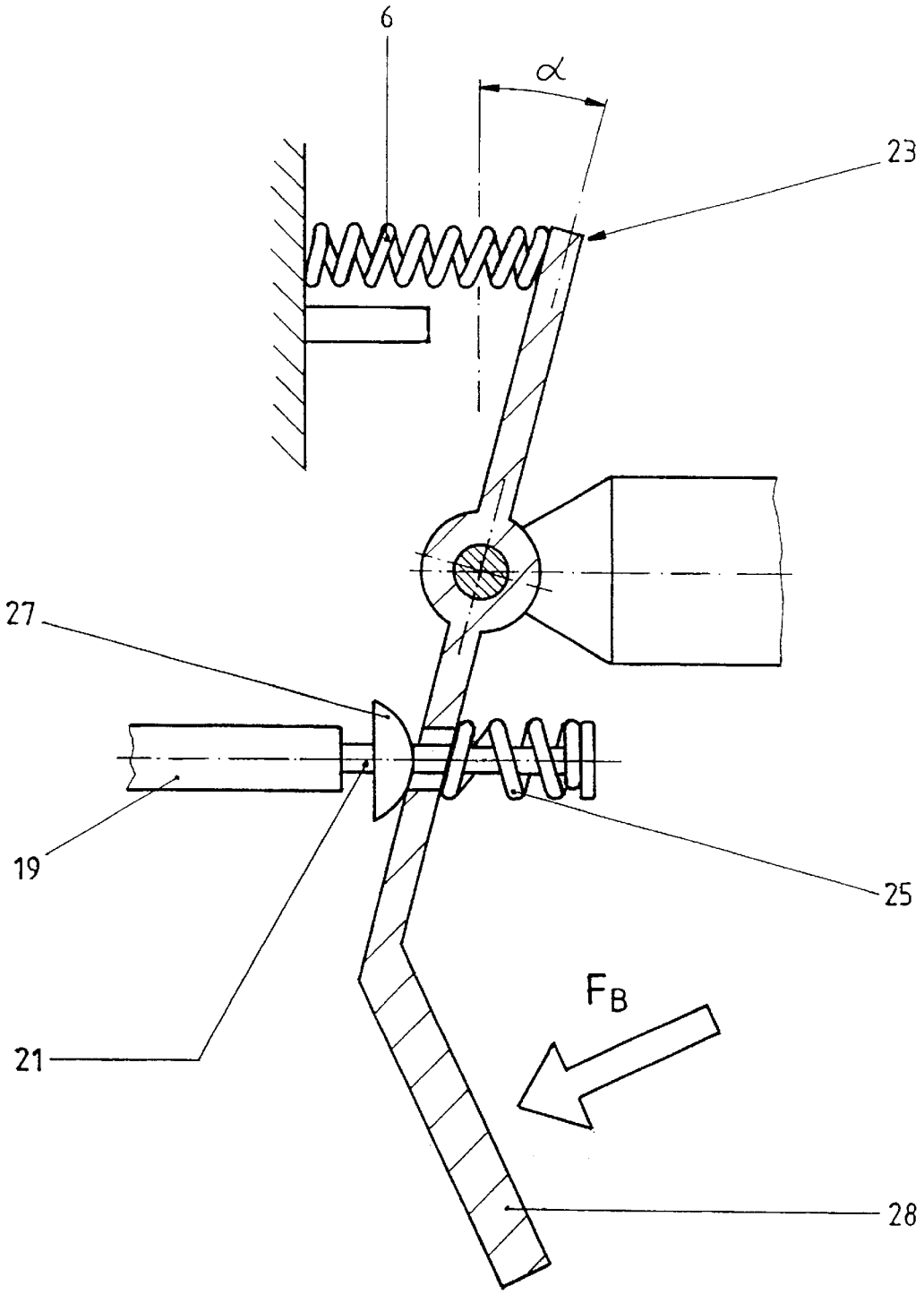
FIG. 5 shows the pedal mechanism illustrated in FIG. 4, in an actuating position.

FIG. 5 shows the pedal lever 23 in an actuating position subjected to the actuating force $F_B$ in a similar way to the illustration in FIG. 2. Compared to the inoperative position illustrated in FIG. 4, the pedal lever 23 is now situated in a position which is deflected against the spring force of the restoring spring, element 6 by an angle of deflection $\alpha$. The actuating force $F_B$ acting on a pedal plate 28 of the pedal lever 23 is transmitted here by means of the component 27 directly to the piston rod 21 of the braking device 19, so that said piston rod is partially inserted into the braking device 19. The spring element 25 is situated here in an insignificantly lengthened position caused by the slightly changed angular position of the piston rod 21 with respect to the pedal lever 23.

Figure 6:
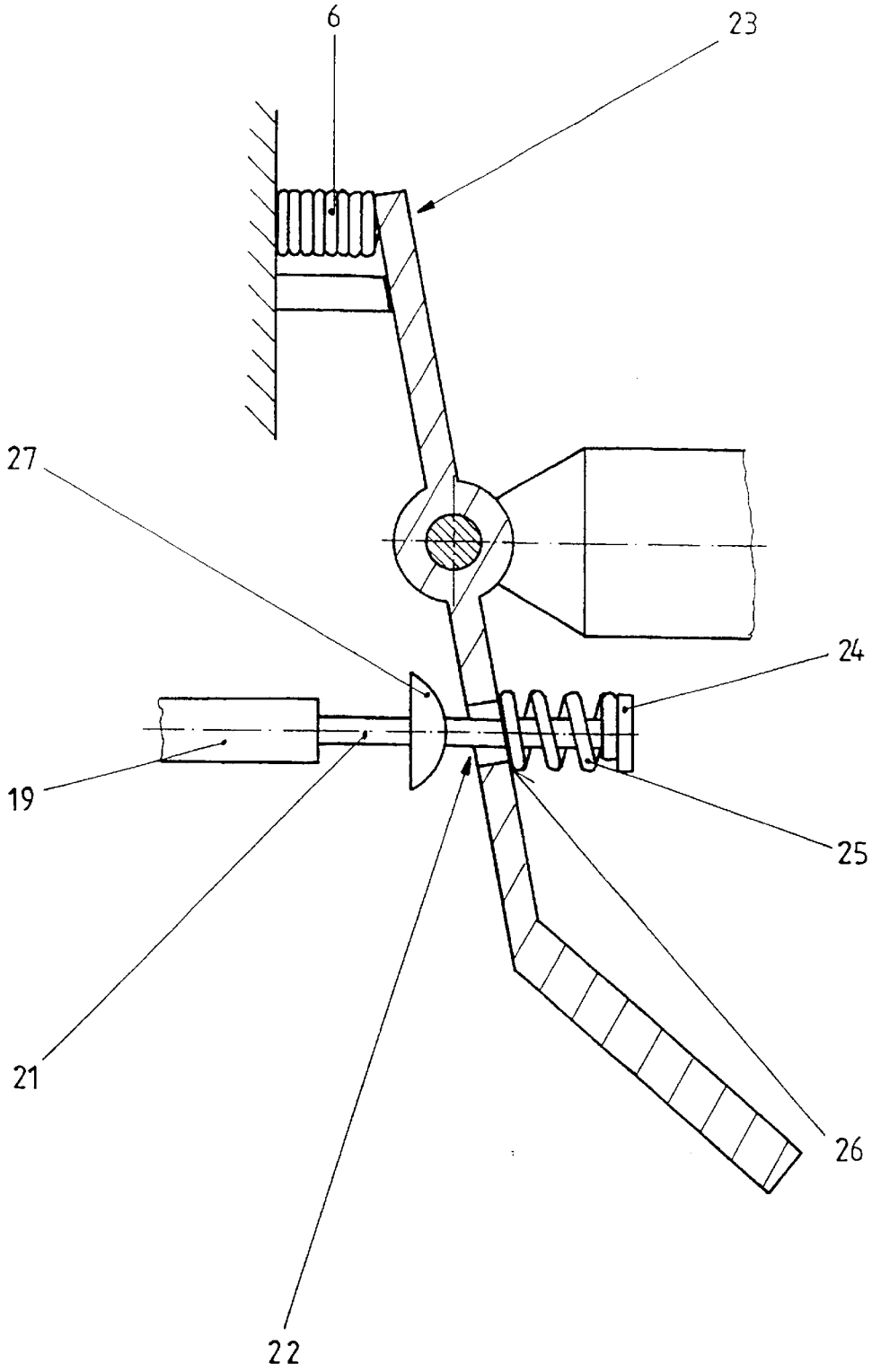
FIG. 6 shows the pedal mechanism illustrated in FIG. 4, in a position after the sudden letting go of the pedal lever.

FIG. 6 shows the pedal lever 23 after the sudden removal of the actuating force ($F_B$), the piston rod 21 being returned into its inoperative position illustrated in FIG. 4 by means of the component 27 which is arranged on it. In this case, the restoring force of the restoring spring element 6 has exceeded the maximum force which can be transmitted to the pedal lever 23 by the spring element 25. In the process, the piston rod 21 of the braking device 19 is pulled as far as possible out of the braking device 19, while the pedal lever 23 is swung far back. As a result, the spring element 25, which is designed as a compression spring, is tensioned between the expanded portion 24 and the edge 26 of the recess 22. In this case, the component 27 which is arranged on the piston rod 21 does not bear against the recess 22. Because of the relatively great spring force of the spring element 25, which is designed as a compression spring, in the inoperative position as compared to the spring force of the restoring spring element 6, the pedal lever 23 is again brought up to the curved component 27 which is connected to the piston rod 21.

I claim:

1. A pedal mechanism for a vehicle, having: a pedal lever, a component, and a restoring spring element, said component and said pedal lever being mounted pivotably about a common axis, said pedal lever being able to be deflected by foot force and is pivotal back into a basic position via a restoring movement by said restoring spring element; an actuating element connected to said component (13, 27) and being actuable by the pedal lever upon a contacting of the component with the pedal lever; and a second spring element, wherein the pedal lever (2, 23) is urged to contact the component by the second spring element (12, 25), said second spring element serving to limit force transmitted via said component to the actuating element (18, 20) by the pedal lever (2, 23) during said restoring movement of the pedal lever (2, 23) by allowing a distancing of the pedal lever (2, 23) from the component and the actuating element (18, 20) during the restoring movement of the pedal lever.

2. The pedal mechanism as claimed in claim 1, wherein said component (13, 27) is arranged between the actuating element (18, 20) and the second spring element (12, 25), said component being movable together with the pedal lever (2, 23) in an actuating direction and, in restoring direction, said component is movable relative to the pedal lever (2, 23) against spring force of the second spring element (12, 25).

3. The pedal mechanism as claimed in claim 2, wherein the component (13, 27) bears against the pedal lever (2, 23) when the latter is actuated.

4. The pedal mechanism as claimed in claim 1, wherein the pedal lever (2, 23) is a brake pedal lever and the actuating element (18, 20) is a braking device (17, 19).

5. The pedal mechanism as claimed in claim 1, wherein the second spring element (12) is a tension spring.

6. The pedal mechanism as claimed in claim 1, wherein the second spring element (25) is a compression spring.

7. The pedal mechanism as claimed in claim 1, wherein in the basic position spring force of the second spring element (12, 25) is greater than spring force of the restoring spring element (6).

8. A pedal mechanism for a vehicle, having: a pedal lever, and a component; said component and said pedal lever being mounted pivotably about a common axis, said pedal lever being able to be deflected by foot force and is pivotal back into a basic position by a restoring spring element; an actuating element drivable by the component and being actuable by the pedal lever via the component upon a contacting of the component with the pedal lever; and a second spring element which urges the pedal lever to contact the component (13, 27), wherein a rotation of the pedal lever in a direction of actuation of the actuating element rotates the component in the actuation direction for actuation of the actuating element, said second spring element being provided between the pedal lever and the component so as to limit force transmitted via the component (13, 27) to the actuating element (18, 20) by the pedal lever (2, 23) during a restoring movement of the pedal lever (2, 23), in a direction of rotation opposite to said actuation direction, by a distancing of the pedal lever (2, 23) from the component.

9. The pedal mechanism as claimed in claim 8, wherein said component is connected to said actuating element.

10. The pedal mechanism as claimed in claim 8, wherein said pedal lever is held in contact with said component by said second spring element in an actuating direction.

11. The pedal mechanism as claimed in claim 8, wherein the restoring spring element is fixed to said pedal lever for prestressing said pedal lever in a releasing position.

* * * * *